US007216708B1

(12) United States Patent
Bond et al.

(10) Patent No.: US 7,216,708 B1
(45) Date of Patent: May 15, 2007

(54) REACTIVE STIMULATION OF OIL AND GAS WELLS

(76) Inventors: Lesley O. Bond, 707 Peterson Rd., Neosho, MO (US) 64850; Ercill Ray Hunt, 611 FM 980 S, Point Blank, TX (US) 77364; Glenn Bob Barnett, 8936 N. 139th E. Ave., Owasso, OK (US) 74055

( * ) Notice: Subject to any disclaimer, the term of this patent is extended or adjusted under 35 U.S.C. 154(b) by 67 days.

(21) Appl. No.: 10/782,336

(22) Filed: Feb. 19, 2004

Related U.S. Application Data

(60) Provisional application No. 60/502,703, filed on Sep. 12, 2003.

(51) Int. Cl.
*E21B 29/00* (2006.01)

(52) U.S. Cl. ..... 166/297; 175/4.6

(58) Field of Classification Search ..... 175/4.6, 175/4.57, 3.5; 166/247, 55.1; 507/276; 102/476, 306, 307–310
See application file for complete search history.

(56) References Cited

U.S. PATENT DOCUMENTS

| | | | | |
|---|---|---|---|---|
| 2,640,547 | A | 6/1953 | Baker et al. | |
| 2,656,003 | A | 10/1953 | Poulter | |
| 2,831,429 | A | 4/1958 | Moore | |
| 2,935,020 | A | 5/1960 | Howard et al. | |
| 3,013,491 | A | 12/1961 | Poulter | |
| 3,727,690 | A | 4/1973 | Munson | |
| 3,791,255 | A | 2/1974 | Fox et al. | |
| 3,948,181 | A | 4/1976 | Bergstrom | |
| 3,967,553 | A | 7/1976 | Keraus et al. | |
| 4,039,361 | A | 8/1977 | Ray et al. | |
| 4,160,412 | A | 7/1979 | Snyer et al. | |
| 4,237,787 | A | 12/1980 | Wacula et al. | |
| 4,254,828 | A | 3/1981 | Sowa et al. | |
| 4,305,463 | A | 12/1981 | Zakiewicz | |
| 4,391,337 | A * | 7/1983 | Ford et al. | 175/4.6 |
| 4,456,492 | A | 6/1984 | Alexander et al. | |
| 4,499,945 | A | 2/1985 | Hill et al. | |
| 4,519,453 | A | 5/1985 | Riddiford | |
| 4,581,082 | A | 4/1986 | Hagel et al. | |
| 4,658,916 | A | 4/1987 | Bond | |
| 4,669,542 | A | 6/1987 | Venkatesan | |
| 4,719,856 | A * | 1/1988 | Joslin | 102/335 |
| 4,728,376 | A | 3/1988 | Kurtz | |
| 4,824,495 | A | 4/1989 | Verneker | |

(Continued)

*Primary Examiner*—William Neuder
*Assistant Examiner*—Nicole A Coy
(74) *Attorney, Agent, or Firm*—Mary M. Lee

(57) ABSTRACT

A method and apparatus for stimulating producing strata in oil or gas wells. The formation is penetrated using existing shaped charges, and an oxygen-rich material then is introduced into the producing formation. Thus, oxygen is available within the formation to sustain an explosive reaction with the existing formation hydrocarbons acting as fuel. This explosive reaction will cause fracturing of the formation and will counteract plugging that often results from the use of conventional shaped charges. In one embodiment, a container encloses shaped charges surrounded by oxygen-rich material. The shaped charges are ignited first, perforating the well casing and any surrounding cement. Additional explosive charges at each end of the container then are ignited. This forces the oxygen-rich material into the perforation tunnels. Alternately, the oxygen can be a part of the shaped charge and projected into the formation with the shaped charge to accomplish the same results.

37 Claims, 6 Drawing Sheets

U.S. PATENT DOCUMENTS

| | | | |
|---|---|---|---|
| 5,045,046 | A | 9/1991 | Bond |
| 5,259,317 | A | 11/1993 | Lips |
| 5,346,014 | A | 9/1994 | Ross |
| 5,452,763 | A | 9/1995 | Owen |
| 5,868,202 | A | 2/1999 | Hsu |
| 5,957,196 | A | 9/1999 | Gibson et al. |
| 6,009,946 | A | 1/2000 | McKelvey |
| 6,276,453 | B1 | 8/2001 | Bond |
| 6,571,867 | B2 | 6/2003 | Bond |
| 2003/0037692 | A1 | 2/2003 | Liu |

* cited by examiner

REACTIVE STIMULATION OF OIL AND GAS WELLS

This application claims the benefit of the filing date of provisional application Ser. No. 60/502,703, entitled "Reactive Stimulation of Oil and Gas Wells," filed Sep. 12, 2003, the contents of which are incorporated herein by reference.

FIELD OF THE INVENTION

The present invention relates to methods and devices for stimulating producing formations in oil and gas wells to increase production.

BACKGROUND OF THE INVENTION

The quantity of oil and gas production from a hydrocarbon bearing strata into a borehole is influenced by many physical factors. Darcey's flow equation, which defines flow in a well, takes into account the reservoir constants of temperature, viscosity, permeability, reservoir pressure, pressure in the borehole, thickness of the producing strata, and the area exposed to flow.

It has long been known that increasing the exposed flow area in a producing well increases production. For example, it is known that drilling a larger diameter hole exposes more of the producing strata and thus increases production.

Enlarging the flow areas, in open hole intervals, has been accomplished by using both explosives and chemicals. However, use of these agents is somewhat limited where the producing strata are cemented behind steel casing. In cased applications, the well is "perforated" to create small holes that extend through the steel casing, the annulus cement and the adjacent formation.

Prior to the invention of the shaped charge, wells were perforated with multiple, short-barreled guns. The bullets penetrated the casing, the annulus cement, and the producing strata. The shaped charge, with its greater penetration and reliability, though, has largely replaced the so-called "bullet guns."

A shaped charge makes a hole through the casing and into the strata by forming a high speed stream of particles that are concentrated in a small diameter jet. As the high energy particles hit solid material, the solid material is pulverized. Thus, shaped charges can be used to place numerous small perforations where desired in a well. However, the fine material from the pulverized rock and the shaped charge particles can have a detrimental effect on fluid flow in the area around the perforation. Debris from the spent charge as well as fragments and particles from the pulverized formation tend to plug the perforations and obstruct passages in the fractured formation.

The formation pressure acts on the small oil droplets in the formation to force the hydrocarbons from the connected pore spaces into the well bore. The magnitude of the area in the formation exposed by the perforations directly affects the amount of flow and/or work required for that production. Accordingly, increasing the exposed flow area by perforation does two favorable things: it increases the flow rate directly, and, it reduces the amount of work required to maintain a given production rate. Increasing the flow area in a well increases the ultimate recovery from the well/reservoir by conserving formation pressure or reservoir energy.

The present invention provides a method and apparatus capable of increasing the exposed surface area in a formation when using shaped charges to perforate a well. This apparatus and method augment the use of shaped charges by including the introduction of oxygen rich material into the formation with the explosive. The delivery of an oxygen source to the hydrocarbon-containing formation, in the presence of the explosive reaction, provides sustained explosive burning of the hydrocarbons in the vicinity of the perforation. The burning in the formation continues until the oxygen-rich material is depleted, when the burning self-extinguishes. Thus, the extent of the burning can be controlled by selecting the amount of oxygen-rich material to be introduced into the formation.

This significant secondary reaction in the strata has two beneficial effects. In the first place, the reaction will cause a cleaning effect on the fine particles that might otherwise plug the perforation. The cleaning effect occurs when the explosive burning causes high pressure gases to be generated, and these pressurized gases are discharged rapidly back into the borehole or casing. Secondly, the extended burning or explosion in the treated statum causes further fracturing of the formation. This results in further expansion of the exposed flow areas in the formation beyond the initial shaped charge perforation. In addition, in the event the strata being perforated are water bearing, the explosive reaction will not occur; rather, only oil or gas bearing formations will be stimulated.

SUMMARY OF THE INVENTION

The present invention is directed to apparatus for stimulating production from a hydrocarbon-containing formation in an oil or gas well. The apparatus comprises a container sized to be received and supported in the well at a level adjacent the formation. At least one shaped charge is supported within the container. The shaped charge is adapted, when ignited, to perforate the formation and to initiate a burn of hydrocarbons therein. The apparatus includes a supply of oxygen-rich material supported within the container and adapted to be introduced explosively into the formation with the shaped charge. In this way, the burn of hydrocarbons therein is extendable. The apparatus further includes at least one igniter for detonating the shaped charge.

Still further, the present invention comprises a method for stimulating production from a hydrocarbon-containing formation in an oil or gas well. The method comprises perforating the formation using a shaped charge and introducing an oxygen-rich material to the formation. Thus, the burn of the hydrocarbons is enhanced.

DETAILED DESCRIPTION OF THE PREFERRED EMBODIMENT(S)

Figure 1:
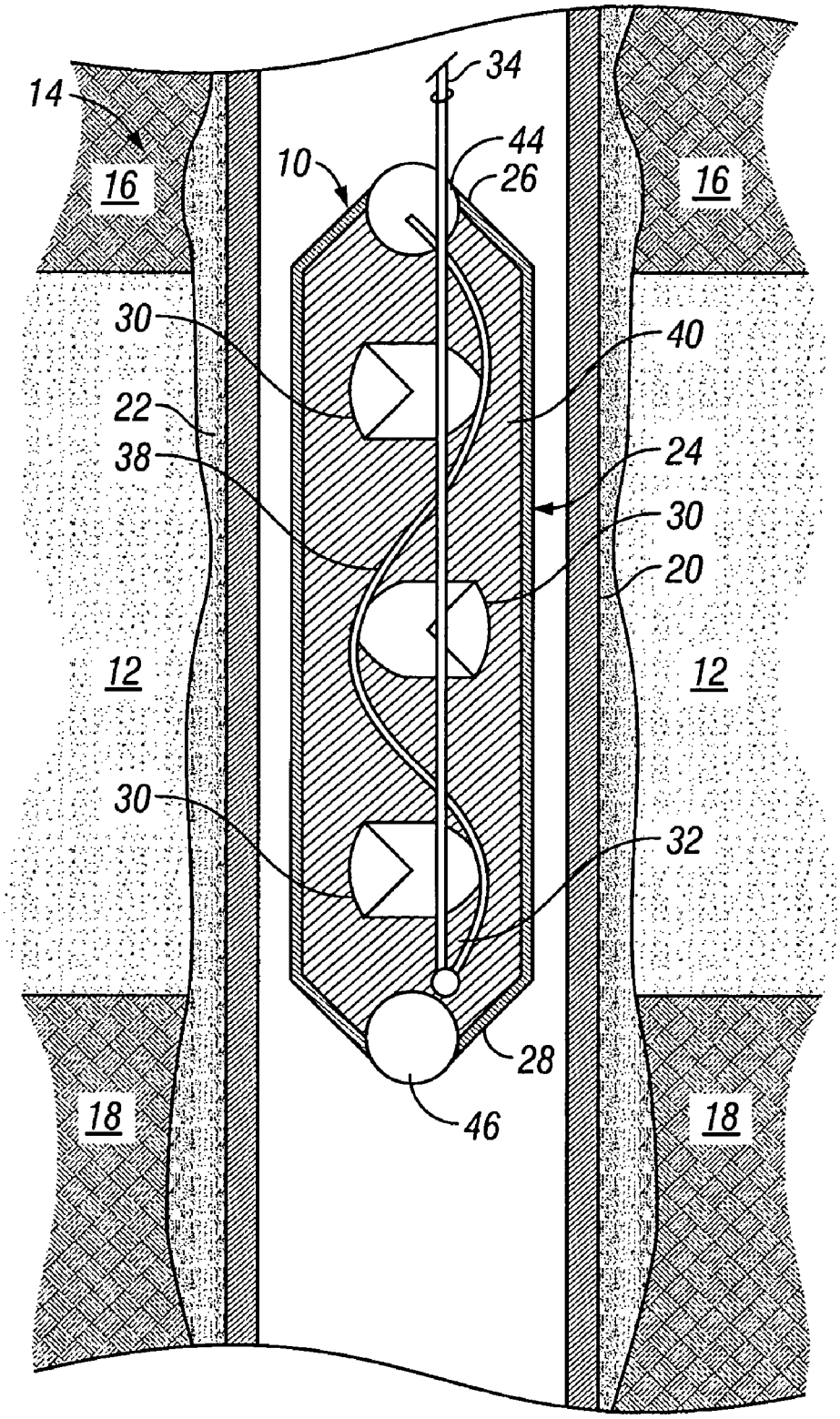
FIG. 1 is a longitudinal section view of an apparatus in accordance with a first embodiment of the present invention. The apparatus is shown positioned at the level of a target formation in an oil or gas well.
Figure 2:
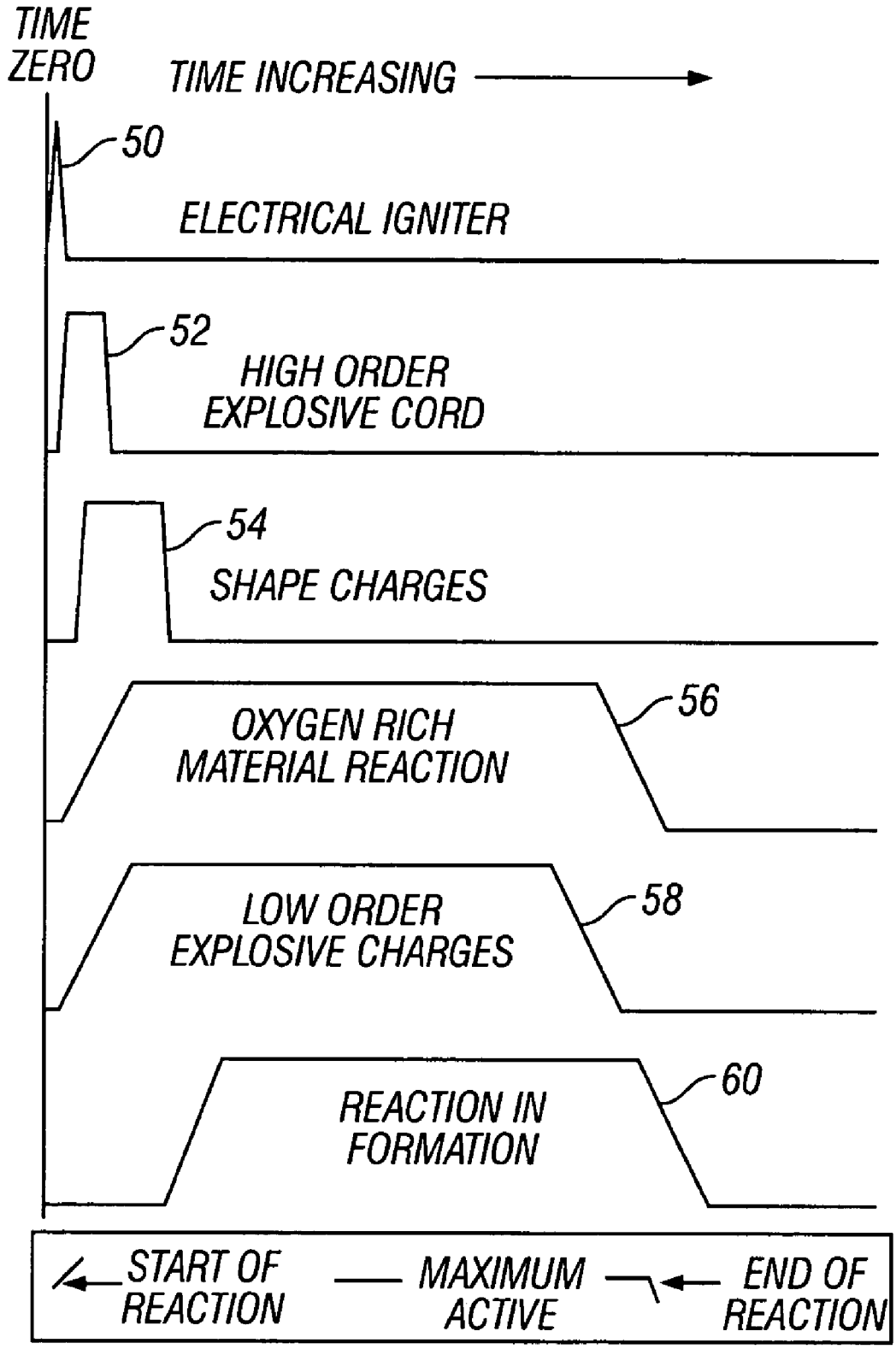
FIG. 2 is a schematic diagram illustrating the timing of the sequence of events produced by the apparatus of FIG. 1.
Figure 3:
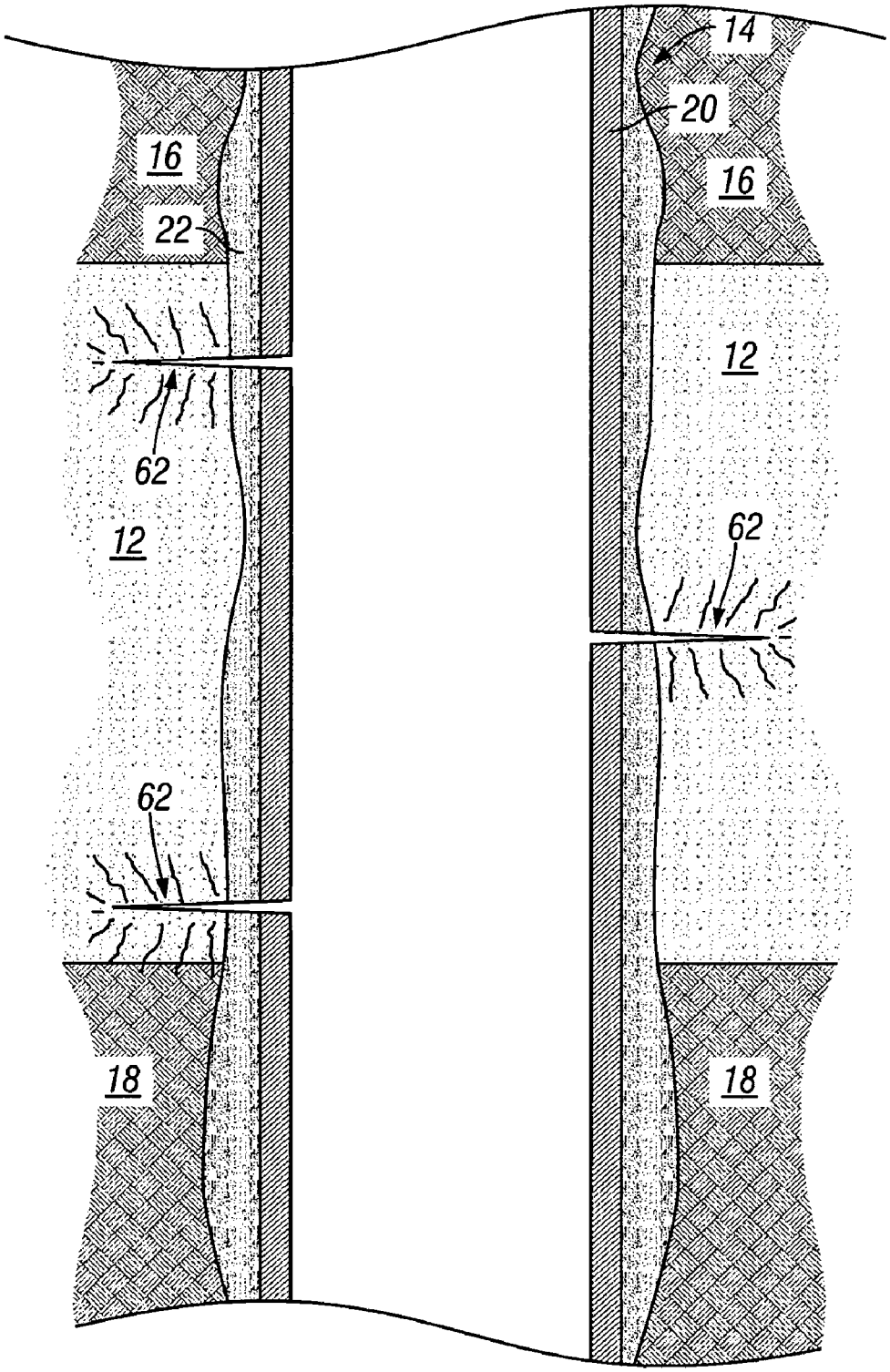
FIG. 3 is a fragmented sectional view of the target formation shown in FIG. 1 after completion of the stimulation treatment.

The Embodiment of FIGS. 1–3

With reference now to the drawings in general and to FIG. 1 in particularly, there is shown therein an apparatus constructed in accordance with a first preferred embodiment of the present invention and designated generally by the reference numeral 10. The apparatus 10 is adapted to stimulate production from a hydrocarbon-containing formation or strata 12 in an oil or gas well 14.

An illustrative well environment is shown in FIG. 1 and comprises shale zones 16 and 18 above and below the formation 12. In most instances, the apparatus 10 will be used in a cased interval of the well 14, and the casing of the well 14 is indicated at 20 with the cement in the annulus designated at 22.

The apparatus 10 comprises a container 24 sized to be received and supported in the well 14 at a level adjacent the formation 12. Preferably, the container 24 is elongated having first and second ends 26 and 28.

The apparatus 10 further comprises at least one shaped charge supported within the container 24. The shaped charge is adapted, when ignited, to perforate the formation. Preferably, there is a plurality of shaped charges that can be positioned to perforate different locations in the formation 12. More preferably, there are three shaped charges, such as the charges 30. This embodiment may use conventional shaped charges. Accordingly, no detailed description of the shaped charges 30 is provided herein.

With continuing reference to FIG. 1, an igniter of some sort is provided to detonate the shaped charges 30. In the preferred embodiment of FIG. 1, the igniter comprises an electrical igniter 32 disposed within container 24. The igniter 32 is electrically connected to a conductor wire 34 which extends from the apparatus 10 to the well head (not shown). As shown here, the conductor wire 34 may be used to suspend the apparatus 10 in the well 14.

Extending from the igniter 32 is a primer cord 38. Preferably, the primer cord comprises a high order explosive, and is crimped into and made a part of the igniter 32. The primer cord 38 connects to the shaped charges 30 in series. Thus, when the igniter 32 is initiated by a signal from the surface through the conductor wire 34, the shaped charges 30 will be ignited by the fast burning primer cord 38, which runs from the igniter 32 to the uppermost shaped charge 30 in the plurality of charges.

Referring still to FIG. 1, the apparatus 10 preferably also includes a supply of oxygen-rich material supported within the container 24 and adapted to be introduced explosively into the formation 12 with the shaped charges, such as the charges 30. This will provide a source of oxygen to support explosive burning of the hydrocarbons in the formation.

In the embodiment of FIG. 1, the oxygen-rich material 40 in the container 24 is external to and surrounds the shaped charges 30. Preferably, the oxygen-rich material 40 is potassium nitrate. However, the other materials such as ammonium nitrate may be utilized in addition to or instead of potassium nitrate. As used herein, "oxygen-rich material" denotes any material capable of releasing oxygen when activated.

To propel the oxygen-rich material 40 through the perforations behind the shaped charges 30, the apparatus is provided with separate delivery explosives in the form of end charges 44 and 46. The end charges 44 and 46 preferably are composed of a slow burning (low order) explosive and may be positioned at the first and second ends 26 and 28, respectively, of the container 24. When thus arranged, it is convenient to attach the primer cord 38 to the end charges 44 and 46, as shown in FIG. 1. Thus, a single signal on the conductor wire 34 to the igniter 32 will ignite the end charges 44 and 46 as well as the shaped charges 30 via the primer cord 34.

The end charges 44 and 46, positioned at each end of the supply of oxygen-rich material 40, will create very high pressures momentarily inside the container 24 and the well casing 20. This pressure will force the oxygen-rich material 40 out through the perforations in the casing 20, the annulus cement 22, and into the surrounding formation 12 immediately behind the shaped charges. This in turns causes explosive burning of the hydrocarbons in the formation 12 that is supported by the oxygen being released by the oxygen-rich material 40.

The operation of the apparatus of FIG. 1 is explained with reference to the diagram in FIG. 2. At Time Zero, the signal from the conductor wire 34 triggers the igniter 32 (FIG. 1), which in turn initiates the explosive reaction in the fast burning primer cord 38 that runs the length of the container 24. The reaction time of the igniter 32 is shown at 50 on the time graph in FIG. 2. The spike has a duration of about 0.0500 milliseconds, and the total reaction time of the igniter is about 0.200 milliseconds.

The igniter 32 initiates the reaction in the fast burning primer cord 38. Being a fast burning explosive, the cord 38 burns from the igniter to the cord end very rapidly, for a duration of about 0.500 milliseconds indicated at 52 in FIG. 2. The preferred primer cord 38 burns at about 20,000 feet per second. Thus, the primer cord 38 could travel a 10-foot string of 40 shaped charges, for example, in only about 0.500 milliseconds.

The primer cord 38 ignites the shaped charges 30, the oxygen-rich material 40, and the low order explosives in the end charges 44 and 46. Due to fast burning (high order) explosives in the shaped charges 30, the shaped charges burn rapidly for about 0.100 milliseconds as indicated at 54. However, the much slower burning oxygen-rich material 40 and the end charges 44 and 46 burn for a much longer duration, about 4.000 milliseconds and about 5.000 milliseconds at 56 and 58, respectively.

Referring still to FIG. 2, the secondary reaction in the formation comprising the sustained burning of the hydrocarbons lasts until the oxygen-rich material 40 is depleted, as indicated at 60. The total duration of the reactive explosion of hydrocarbons and oxygen in the formation, therefore, begins shortly after the introduction of oxygen in the perforated hole and into the formation and expires as the pyrotechnic reactions stop for lack of oxygen or other reagents.

The effect of the operation of the apparatus 10 is illustrated in FIG. 3, to which attention now is directed. This drawing illustrates the condition of the well after ignition of the apparatus 10. The container 24 and its components are substantially destroyed, leaving perforations 62 corresponding to the positions of the shaped charges 30. The sustained, explosive burn of the hydrocarbons in the formation surrounding the perforations 62 has substantially increased the surface area for production by fracturing and cleaning the formation.

Figure 4:
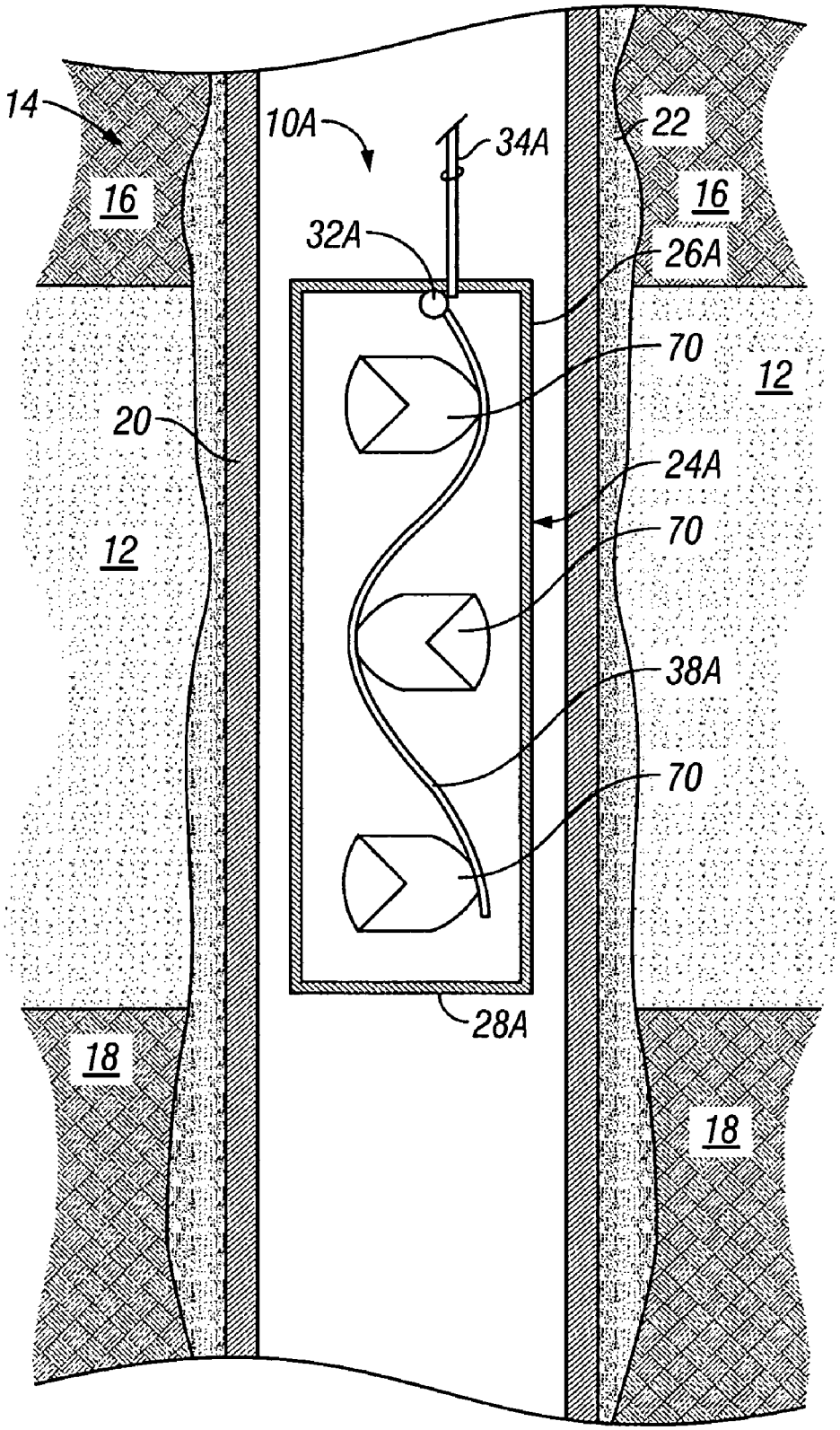
FIG. 4 is a longitudinal sectional view of an apparatus in accordance with a second embodiment of the present invention positioned at the level of a target formation in an oil or gas well.
Figure 5:
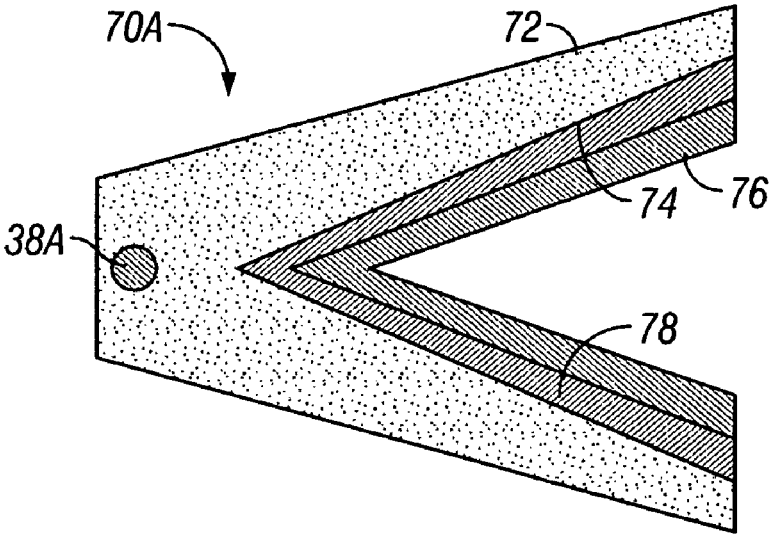
FIG. 5 is a section view of a shaped charge made in accordance with one embodiment of the present invention.
Figure 6:
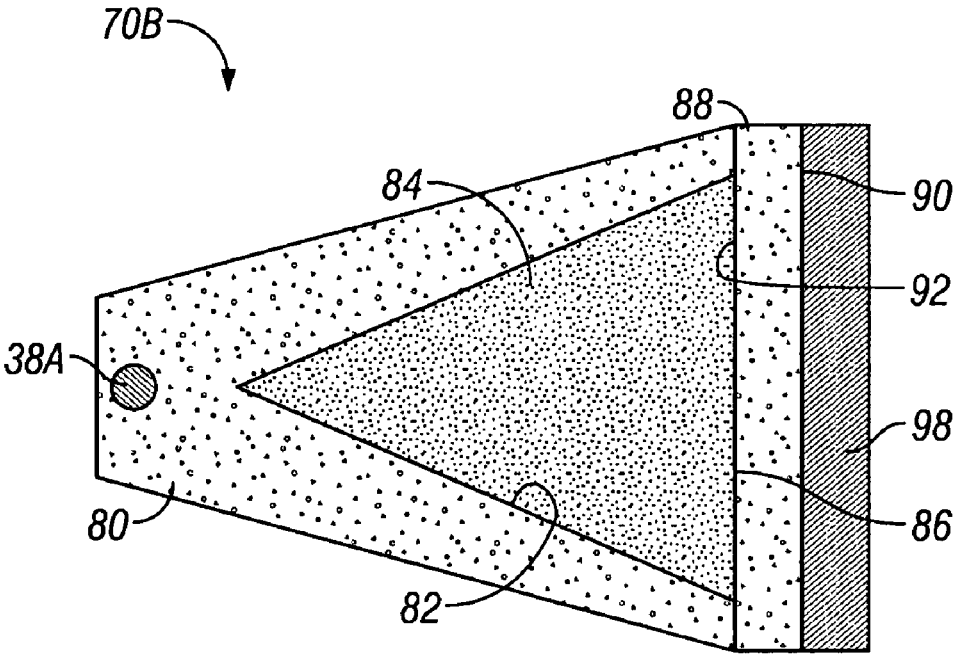
FIG. 6 is a section view of a shaped charge made in accordance with another embodiment of the present invention.

The Embodiment of FIGS. 4–6

Shown in FIG. 4 is another preferred embodiment of the apparatus of the present invention. In this embodiment, the apparatus 10A comprises an elongated container 24A having first and second ends 26A and 28A. The container 24A is suspended by a conductor wire 34A similar to the corresponding components of the apparatus 10 of FIG. 1. An electrical igniter 32A, which may be similar to the igniter 32 of the previous embodiment, is supported near the first end 26A of the container 24A.

At least one and preferably three shaped charges 70 are supported inside the container 24A. As in the previous embodiment, the shaped charges 70 preferably are connected in series to a primer cord 38A, which is connected to the igniter 32A. Generally, it is desirable to average about four shaped charges per foot.

The apparatus 10A also includes a supply of oxygen-rich material. However, in this embodiment, the oxygen-rich material is contained in the shaped charges 70.

One preferred embodiment for the "oxygenated" shaped charge 70 of this invention is shown in FIG. 5 and designated as 70A. The shaped charge 70A comprises a body of high explosive 72 formed to have a conically shaped frontal recess 74.

A detonator is included in the shaped charge 70A to ignite the body of explosive 72. The detonator may be the primer cord 38A running therethrough.

A liner 76, usually of copper, is included. The liner 76 is shaped to line the frontal recess 74 in the body of explosive 72. Thus, the liner 76 in this configuration is conical.

Still further, a layer of oxygen-rich material 78 is included in the shaped charge 70A. In the preferred form, the oxygen-rich layer 78 is positioned between the conical copper liner 76 and the conical frontal recess 74 of the body of explosive 72. The conically shaped oxygen-rich material 78 and the conically shaped copper liner 76 thus form a bimetallic liner for the shaped charge 70.

After the primer cord 38A ignites the high explosive 72, the rapid burning of explosive 72 will convert the conically shaped copper liner into a rapidly moving jet that will perforate the casing and the formation (neither shown in this Figure). At the same time, the conically shaped oxygen-rich layer 78 will also be converted into a slower moving slug of oxygen-rich material. This slower moving slug follows the rapidly moving jet into the formation where, in the presence of the jet and the hydrocarbons in the formation, the oxygen-rich slug will support an extended burn of the hydrocarbons.

Shown in FIG. 6 is another embodiment of a shaped charge in accordance with the present invention designated as 70B. In this embodiment, the shaped charge 70B comprises a conically shaped body of fast burning explosive 80. The recess 82 is also conical in shape. A detonator is included, such as the primer cord 38A, to ignite the fast burning explosive 80.

The shaped charge 70B further comprises a conically shaped insert 84 of slower burning (lower order) explosive. The insert 84 is shaped to conform to and be received in the frontal recess 82 of the body 80. Thus, the insert 84 in the embodiment shown is conically shaped. Further, the insert 84 is shaped to have a planar front 86.

Referring still to FIG. 6, the shaped charge 70B comprises a disc shaped layer 88 of fast burning explosive. The fast burning layer 88 has a front 90 and a rear 92. The rear 92 is fixed to the planar front 86 of the insert 84.

Still further, the shaped charge 70B includes a disc shaped layer 98 of elastic material molded at high pressure to contain an oxygen-rich material, such as potassium nitrate fixed on the front of the fast burning layer 88.

It is now seen that, when the shaped charge 70B is detonated, the oxygen-rich disk 98 will be propelled through the casing 20 and cement annulus 22. The initial movement of the disc of oxygen-rich material 98 will be ahead of the shaped charge jet. However, the shaped charge jet will quickly pierce the disc of oxygen-rich material 98 and will proceed to make the perforation through the casing 20 and cement annulus 22. The solid oxygen-rich disk 98 becomes a projectile that follows the jet into the perforation tunnel. The disk 98 supports the combustion of hydrocarbons in the formation ignited by the jet for the selected duration.

Figure 7:
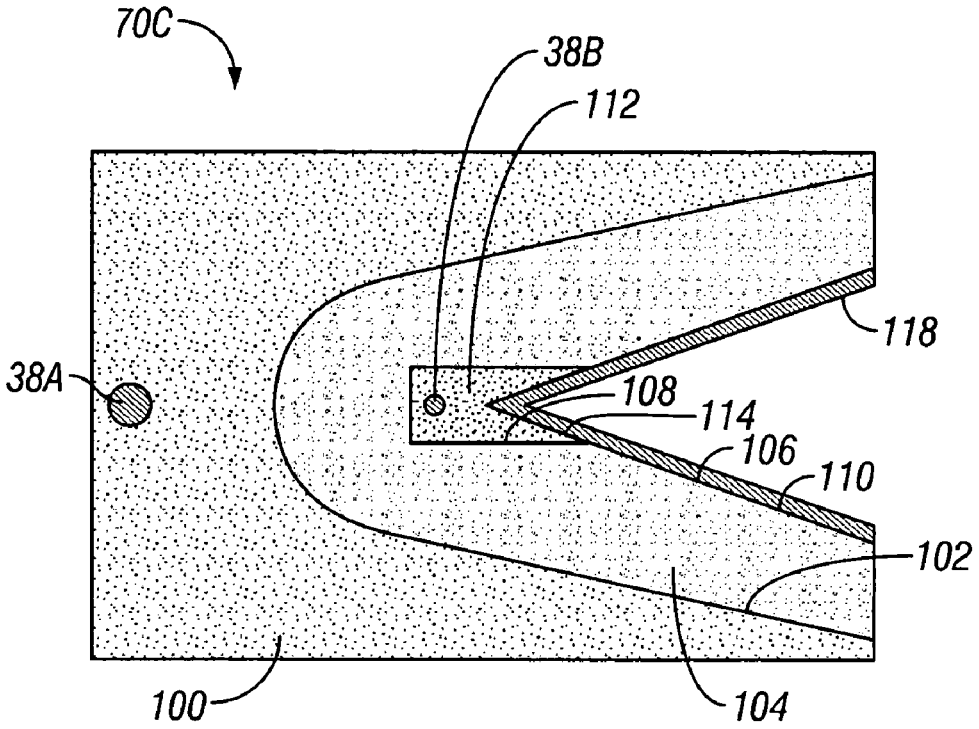
FIG. 7 is a section view of a shaped charge made in accordance with another embodiment of the present invention.

Turning now to FIG. 7, another embodiment of the "oxygen-loaded" shaped charge will be described. This embodiment, designated generally by the reference numeral 70C, comprises a first body 100 of fast burning explosive formed to have a frontal recess 102. Preferably, the frontal recess 102 is generally conical in shape and the apex is curved or domed instead of pointed.

Also included is a body of oxygen-rich material 104, such as potassium nitrate, formed to be received in the frontal recess 102 of the first body of explosive 100 and to have a frontal recess 106. The frontal recess 106 has a cylindrical center portion 108 and a frusto-conical forward portion 110.

Still further, the shaped charge 70C comprises a second body 112 of fast burning explosive shaped to conform to and be received in the cylindrical center 108 of the recess 102 in the body of oxygen-rich material 104. The second body 112 is also shaped to have a conical front recess 114 continuous with the frusto-conical forward portion 110 of the frontal recess 106 in the body of oxygen-rich material 104. In this way, the frontal recess 114 of the second body of explosive 112 and the frusto-conical portion 110 of the frontal recess 106 in the oxygen-rich material 104 form a complete cone.

The charge 70C includes detonators, such as the primer cords 38A and 38B, adapted to ignite the first body of fast burning explosive 100 and the second body of fast burning explosive 112. A conically shaped metal liner 118 is positioned inside the complete cone formed by the frontal recess 114 of the second body of explosive 104 and the frusto-conical portion 110 of the frontal recess 106 in the oxygen-rich material 104.

The primer cords 38A and 38B ignite the first and second bodies of fast burning explosives 100 and 112. Then, second body of high order explosive 112 will collapse the liner 118 to form a high velocity jet which will penetrate the casing, cement, and formation. Concurrently, the first body of high order explosive 100 propels the oxygen rich material 104 into the perforation tunnel in time to support the reaction of the jet and the hydrocarbons in the formation.

Figure 8:
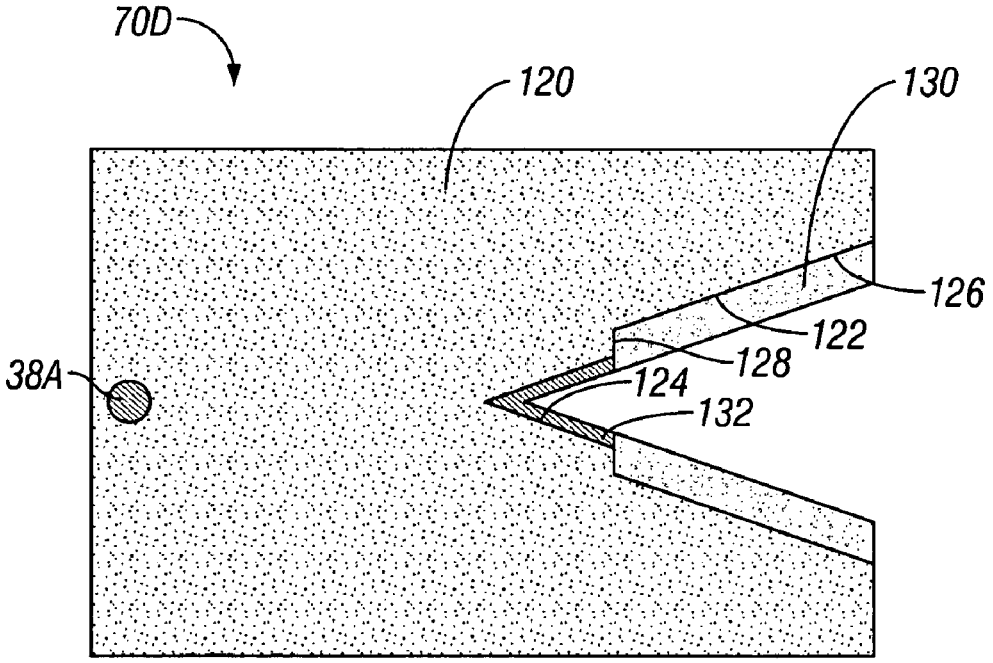
FIG. 8 is a section view of a shaped charge made in accordance with another embodiment of the present invention.

With reference now to FIG. 8, yet another embodiment of a shaped charge will be described. This shaped charge, designated generally as 70D, comprises a body of fast burning explosive 120. The body of explosive 120 is formed to have a stepped frontal recess 122 with a conical center portion 124 and a frusto-conical forward portion 126. The narrowest diameter of the forward portion 126 forms a step 128 between the center portion 124 and the forward portion 126.

The charge 70D further comprises a body of oxygen-rich material 130 formed to be received in frusto-conical forward portion 126 of the frontal recess 122 of the body of explosive 120. The narrowest diameter of the body of oxygen-rich material 130 is substantially the same as the widest diameter of the center portion 124 of the frontal recess 122 of the body of fast burning explosive 120. Thus, the conical center portion 124 of the frontal recess 122 of the body of explosive 120 and the body of oxygen-rich material 130 form a complete cone.

A detonator, such as the primer cord 38A is adapted to ignite the body of fast burning explosive 120. Also, included is a conically shaped liner 132 positioned inside the conical center portion 124 of the frontal recess 122 in the body of fast burning explosive 120.

The primer cord 38A ignites the body of fast burning explosives 120. Then, the liner 132 and a small part of the oxygen rich material 126 will collapse into a high velocity jet that will penetrate the casing, cement, and formation. The remaining oxygen rich material 126 will form a slower moving slug that will enter the perforation tunnel in time to support the reaction of the jet and the hydrocarbons in the formation.

In accordance with the method of the present invention, there is provided a method for stimulating the hydro-carbon containing strata in an oil and gas well. First, preferably using one of the above described apparatus, the formation is perforated using a shaped charge. An oxygen-rich material, such a potassium nitrate, is introduced into the formation to support a sustained burn of the hydrocarbons therein.

Whether the apparatus 10A with the shaped charge 70B is employed or the shaped charge 70A is utilized or the apparatus 10 of FIG. 1 is used, the oxygen-rich material is forced into the formation following the shaped charge jets. In all cases, though, a supply of oxygen-rich material is dispersed through the altered formation in the presence of ignited hydrocarbons so that a sustained burn can occur. This effectively increases the exposed surface area and enhances production from the altered formation.

Changes can be made in the combination and arrangement of the various parts and elements described herein without departing from the spirit and scope of the invention as defined in the following claims.

What is claimed is:

1. An apparatus for stimulating production from a hydro-carbon-containing formation in an oil or gas well, the apparatus comprising:

a container sized to be received and supported in the well at a level adjacent the formation;

at least one shaped charge supported within the container, the shaped charge adapted when ignited to perforate the formation;

a supply of oxygen-rich material in each of the shaped charges and adapted to be propelled into the formation by the explosion of the shaped charge, wherein the oxygen-rich material is not explosively reactive with water and is capable of fueling the burning of hydro-carbons in the formation regardless of the presence of water in the well when the shaped charge is ignited; and at least one igniter for detonating the shaped charge.

2. The apparatus of claim 1 wherein the container is elongated having first and second ends.

3. The apparatus of claim 2 wherein the apparatus further comprises a high order primer cord in contact with each of the at least one shaped charge and adapted to be ignited by the igniter.

4. The apparatus of claim 3 wherein the igniter is an electric igniter.

5. The apparatus of claim 2 wherein the at least one shaped charge comprises a plurality of shaped charges positioned to perforate different locations in the formation.

6. The apparatus of claim 5 wherein the apparatus further comprises a high order primer cord in contact with each of the at least one shaped charge and adapted to be ignited by the igniter.

7. The apparatus of claim 1 wherein the oxygen-rich material is potassium nitrate.

8. The apparatus of claim 1 wherein the at least one shaped charge comprises a plurality of shaped charges positioned to perforate different locations in the formation.

9. The apparatus of claim 8 wherein the apparatus further comprises a high order primer cord in contact with each of the at least one shaped charge and adapted to be ignited by the igniter.

10. The apparatus of claim 1 wherein the igniter is an electric igniter.

11. The apparatus of claim 8 wherein the apparatus further comprises a primer cord in contact with each of the at least one shaped charge.

12. The apparatus of claim 1 wherein each of the at least one shaped charge comprises:

a body of explosive formed to have a conical frontal recess;

a detonator adapted to ignite the body of explosive;

a liner shaped to line the frontal recess in the body of explosive; and wherein the oxygen-rich material forms a layer between the liner and the frontal recess of the body of explosive.

13. The apparatus of claim 1 wherein each of the at least one shaped charge comprises:

a body of fast burning explosive formed to have a conical frontal recess;

a detonator adapted to ignite the body of fast burning explosive;

an insert shaped to conform to and be received in the frontal recess in the body of explosive and to have a planar front, the insert formed of a slow burning explosive; and a disc-shaped layer of fast burning explosive having a front and a rear, the rear positioned on the planar front of the insert;

wherein the oxygen-rich material forms a layer on the front of the layer of fast burning explosive.

14. The apparatus of claim 1 wherein each of the at least one shaped charge comprises:

a first body of fast burning explosive formed to have a frontal recess;

a body of oxygen-rich material formed to be received in frontal recess of the first body of explosive and to have a frontal recess with a cylindrical center and a frusto-conical forward portion;

a second body of fast burning explosive shaped to conform to and be received in the cylindrical center of the recess in the body of oxygen-rich material and to have a conical front recess continuous with the frusto-conical forward portion of the frontal recess in the body of oxygen-rich material so that the frontal recess of the second body of explosive and the frusto-conical portion of the frontal recess in the oxygen-rich material form a complete cone;

detonators adapted to ignite the first body of fast burning explosive and the second body of fast burning explosive; and a conically shaped metal liner positioned inside the complete cone formed by the frontal recess of the second body of explosive and the frusto-conical portion of the frontal recess in the oxygen-rich material.

15. The apparatus of claim 1 wherein each of the at least one shaped charge comprises:

a body of fast burning explosive formed to have a stepped frontal recess with a conical center portion and a frusto-conical forward portion having a narrowest diameter to form a step between the center portion and the forward portion;

a body of oxygen-rich material formed to be received in frusto-conical forward portion of the frontal recess of the body of explosive and having a narrowest diameter substantially the same as the widest diameter of the center portion of the frontal recess of the body of fast burning explosive, so that the conical center portion of the frontal recess of the body of explosive and the body of oxygen-rich material form a complete cone;

a detonator adapted to ignite the body of fast burning explosive; and a conically shaped liner positioned inside the conical center portion of the frontal recess in the body of fast burning explosive.

16. A method for stimulating hydrocarbon containing strata in an oil or gas well, the method comprising:

perforating the formation using a shaped charge; and explosively introducing an oxygen-rich material into the formation, wherein the oxygen-rich material is introduced into the formation by the explosive force of the shaped charge, and wherein the oxygen-rich material is not explosively reactive with water and is capable of fueling the burning of hydrocarbons in the formation regardless of the presence of water in the well when the shaped charge is ignited.

17. The method of claim 16 wherein the oxygen-rich material is potassium nitrate.

18. The method of claim 17 wherein the oxygen-rich material is introduced into the formation ahead of the jet from the shaped charge.

19. The method of claim 17 wherein the oxygen-rich material is introduced into the formation behind the jet from the shaped charge.

20. The method of claim 16 wherein the oxygen-rich material is introduced into the formation behind the jet from the shaped charge.

21. The method of claim 16 wherein the oxygen-rich material is introduced into the formation ahead of the jet from the shaped charge.

22. An apparatus for stimulating production from a hydrocarbon-containing formation in an oil or gas well, the apparatus comprising:

a container sized to be received and supported in the well at a level adjacent the formation, wherein the container is elongated having first and second ends;

two end charges of low order explosive material, one positioned at each of the first and second ends of the container;

at least one shaped charge supported within the container between the two end charges, the shaped charge adapted when ignited to perforate the formation;

a supply of oxygen-rich material supported within the container around the shaped charge and adapted to be introduced explosively into the formation with the shaped charge, wherein the oxygen-rich material is not explosively reactive with water and is capable of fueling the burning of hydrocarbons in the formation regardless of the presence of water in the well when the shaped charge is ignited; and at least one igniter for detonating the shaped charge and the end charges.

23. The apparatus of claim 22 wherein the apparatus further comprises a high order primer cord in contact with each of the at least one shaped charges and both the end charges and adapted to be ignited by the igniter.

24. The apparatus of claim 23 wherein the igniter is an electric igniter.

25. The apparatus of claim 22 wherein the at least one shaped charge comprises a plurality of shaped charges positioned to perforate different locations in the formation.

26. The apparatus of claim 25 wherein the apparatus further comprises a high order primer cord in contact with each of the at least one shaped charges and both the end charges and adapted to be ignited by the igniter.

27. The apparatus of claim 25 wherein the oxygen-rich material is potassium nitrate.

28. The apparatus of claim 22 wherein the oxygen-rich material is potassium nitrate.

29. The apparatus of claim 28 wherein the apparatus further comprises a high order primer cord in contact with each of the at least one shaped charges and both the end charges and adapted to be ignited by the igniter.

30. The apparatus of claim 22 wherein the igniter is an electric igniter.

31. The apparatus of claim 30 wherein the at least one shaped charge comprises a plurality of shaped charges positioned to perforate different locations in the formation.

32. The apparatus of claim 30 wherein the oxygen-rich material is potassium nitrate.

33. A shaped charge for use in perforating hydrocarbon-containing formations in oil and gas wells, the shaped charge comprising:

a housing;

a body of fast burning explosive in the housing, the front of the body of explosive defining a rearwardly pointing conical recess;

a detonator adapted to ignite the body of fast burning explosive;

a body of oxygen-rich material in the housing, wherein the oxygen-rich material is not explosively reactive with water and is capable of fueling the burning of hydrocarbons in the formation; and whereby the shaped charge is adapted to perforate the formation and the body of oxygen-rich material is adapted to be introduced explosively into the formation with the shaped charge whereby burning of hydrocarbons therein is promoted regardless of the presence of water in the well when the explosive is ignited.

34. The shaped charge of claim 33 further comprising a liner shaped to line the conical recess in the body of explosive and wherein the oxygen-rich material forms a conically shaped layer between the liner and the body of explosive.

35. The shaped charge of claim 33 further comprising an insert shaped to conform to and be received in the frontal recess in the body of explosive and to have a planar front, the insert formed of a slow burning explosive; and a disc-shaped layer of fast burning explosive having a front and a rear, the rear positioned on the planar front of the insert;

wherein the oxygen-rich material forms a layer on the front of the layer of fast burning explosive.

36. The shaped charge of claim 33 wherein the oxygen-rich material is formed to be received in conical recess of the first body of explosive and is shaped to have a frontal recess with a cylindrical center and a frusto-conical forward portion, and wherein the shaped charge further comprises:

a second body of fast burning explosive shaped to conform to and be received in the cylindrical center of the recess in the body of oxygen-rich material and to have a conical front recess continuous with the frusto-conical forward portion of the frontal recess in the body of oxygen-rich material so that the frontal recess of the second body of explosive and the frusto-conical portion of the frontal recess in the oxygen-rich material form a complete cone;

a detonator adapted to ignite the second body of fast burning explosive; and a liner is positioned inside the complete cone formed by the frontal recess of the second body of explosive and the frusto-conical portion of the frontal recess in the oxygen-rich material.

37. The shaped charge of claim 33 wherein the conical recess in the body of fast burning explosive has a conical center portion and a frusto-conical forward portion, wherein the narrowest diameter of the forward portion is greater than the widest diameter of the center portion to form a step therebetween, where in the shaped charge further comprises a conical liner inside the center portion, and wherein the oxygen-rich material is a frusto-conically shaped layer received in forward portion so that exposed forward surfaces of the liner and the oxygen-rich material form a complete cone-shaped recess.

* * * * *